United States Patent [19]

Torita et al.

[11] Patent Number: 4,862,710

[45] Date of Patent: Sep. 5, 1989

[54] WASHINGS WEIGHT DETECTION AND WASHING OPERATION CONTROL SYSTEM

[75] Inventors: Fumio Torita, Nagoya; Naotaka Ikeda, Yokohama; Kimihiko Nakamura, Seto; Katsuharu Matsuo, Aichi; Tomio Hotta, Kuwana; Yoshiyuki Makino, Nagoya, all of Japan

[73] Assignee: Kabushiki Kaisha Toshiba, Kawasaki, Japan

[21] Appl. No.: 127,959

[22] Filed: Dec. 2, 1987

[30] Foreign Application Priority Data

Mar. 14, 1987 [JP] Japan ..... 62-59693

[51] Int. Cl.[4] ..... D06F 33/02

[52] U.S. Cl. ..... 68/12 R

[58] Field of Search ..... 8/159; 68/12 R; 134/57 D; 340/613; 361/178, 181; 307/118

[56] References Cited

U.S. PATENT DOCUMENTS

| | | | |
|---|---|---|---|
| 3,029,825 | 4/1962 | Cushing | 134/57 D |
| 4,235,085 | 11/1980 | Torita | 68/12 R |
| 4,607,408 | 8/1986 | Didier et al. | 68/12 R X |
| 4,741,182 | 5/1988 | Didier et al. | 68/12 R |
| 4,742,698 | 5/1988 | Torita | 68/12 R |

FOREIGN PATENT DOCUMENTS

| | | | |
|---|---|---|---|
| 2920492 | 12/1979 | Fed. Rep. of Germany | 68/12 R |
| 55-45433 | 3/1980 | Japan . | |
| 56-161091 | 12/1981 | Japan . | |
| 58-195589 | 11/1983 | Japan . | |
| 59-36556 | 9/1984 | Japan | 68/12 R |
| 61-185298 | 8/1985 | Japan | 68/12 R |
| 62-60594 | 3/1987 | Japan | 68/12 R |
| 2175416 | 11/1986 | United Kingdom | 68/12 R |

*Primary Examiner*—Harvey C. Hornsby
*Assistant Examiner*—Stephen F. Gerrity
*Attorney, Agent, or Firm*—Cushman, Darby & Cushman

[57] ABSTRACT

A motor load detector detects an electrical value representing a rise characteristic of a motor, which varies in accordance with a load acting on the motor serving as a power source for a series of operations including a wash cycle and a spin-drying cycle executed by an electric washing machine for washing and spin-drying. A determining section receives a value detected by the motor load detector during the spin-drying cycle, and determines a weight of washings contained in the electric washing machine in accordance with a time which has elapsed until the detected value reaches a second reference value from a first reference value. The determined washings weight is used in a cycle subsequent to the spin-drying cycle.

10 Claims, 8 Drawing Sheets

| DETECTED VOLTAGE (VS') | SOURCE VOLTAGE (Vac) |
|---|---|
| >2.28 (V) | >94 (V) |
| <2.28 - >2.38 | <94 - >98 |
| <2.38 - >2.47 | <98 - >102 |
| <2.47 - >2.57 | <102 - >106 |
| <2.57 | <106 |

FIG. 6

| | WASHINGS WEIGHT / SOURCE VOLTAGE (Vac) | X1 SMALL | X2 MEDIUM | X3 LARGE | |
|---|---|---|---|---|---|
| Y1 | > 94 V | > 9.8" | 9.8"~12.5" | < 12.5" | ELAPSED TIME |
| Y2 | < 94 ~ > 98 | > 7.5" | 7.5" ~ 9.7" | < 9.7" | |
| Y3 | < 98 ~ > 102 | > 5.4" | 5.4" ~ 7.5" | < 7.5" | |
| Y4 | < 102 ~ > 106 | > 3.7" | 3.7" ~ 5.5" | < 5.5" | |
| Y5 | < 106 | > 2.2" | 2.2" ~ 3.6" | < 3.6" | |

FIG. 7

| WLu / WLs | HIGH | MEDIUM | LOW | LOWER | |
|---|---|---|---|---|---|
| HIGH | HIGH | MEDIUM | LOW | LOWER | DECIDED WATER LEVEL |
| MEDIUM | ※ MEDIUM | MEDIUM | LOW | LOWER | |
| LOW | ※ MEDIUM | ※ LOW | LOW | LOWER | |

WASHINGS WEIGHT DETECTION AND WASHING OPERATION CONTROL SYSTEM

BACKGROUND OF THE INVENTION

The present invention relates to a washings weight detection and a washing operation control system for use in an electric washing machine and, more particularly, to an apparatus for use in an electric washing machine which can wash clothes and spin-dry them, for detecting a washings weight, i.e., an amount of clothes and controlling the washing operation in accordance with the detected weight.

Some conventional electric washing machines, which can wash clothes and also spin-dry them, detect a washings weight and use detected data for controlling the washing operation and the like. An example of washings weight detection apparatus for use in such electric washing machines is a capacitive or differential transformer type weight sensor provided at a tub suspending mechanism and the like of an electric washing machine. An electrical quantity, such as a capacitance or inductance generated by the weight sensor, is converted into a frequency by an oscillator. The washings weight is determined in accordance with the frequency.

However, the weight sensor may have mechanical errors made during the manufacture, or may be located in an inappropriate position. For this reason, the accuracy of the washings weight detected by the sensor may be insufficient. Consequently, the accuracy of clothes amount detection may be low.

Another type of a weight sensor is known which detects an electrical value such as the input current of a motor, which varies in accordance with the load acting on the motor driving a rotary tub and an agitator during the washing operation of an electric washing machine, and determines the washings weight from the detected electrical value.

Since this sensor is purely electrical, the load acting on the motor can be correctly detected. However, since the load is detected while clothes are being washed, the relationship between the load and actual washings weight cannot accurately be determined. As a result, the accuracy of washings weight detection is low. That is, at an initial period of washing operation, the clothes in a rotary tub often float on a water surface. Therefore, the clothes do not act on the motor as a load. Moreover, since the clothes irregularly move with respect to the agitator during the washing, the load of the motor irregularly and largely varies. Under such circumstances, the washings weight does not always correspond to the load of the motor. Therefore, even if the load is accurately detected, the washings weight cannot be accurately determined from the detected load.

Therefore, the data detected by the conventional washings weight detection apparatus is not always satisfactory. As a result, the washing operation control cannot be performed well.

SUMMARY OF THE INVENTION

It is, therefore, an object of the present invention to provide a new and improved washings weight detection apparatus for use in an electric washing machine, which can wash clothes and also spin-dry them, in which the load acting on a motor serving as a power source can be accurately detected in correspondence to a washings weight, thereby increasing the accuracy of washings weight detection.

It is another object of the present invention to provide a washing operation control method for an electric washing machine in which the steps of washing operation can be controlled well in accordance with washings weight detection data, and to provide an apparatus for performing this method.

According to an aspect of the present invention, there is provided a washings weight detection apparatus for use in an electric washing machine, the apparatus comprising:

an electric washing machine main body for washing and spin-drying clothes;

a motor serving as a power source for both a wash cycle and a spin-drying cycle executed by the main body;

motor load detecting means for detecting an electrical value representing a rise characteristic which varies in accordance with a load acting on the motor; and determining means for receiving a detected value from the motor load detecting means during the spin-drying cycle and determining a washings weight in the main body on the basis of information concerning time which has elapsed until the detected value reaches a second reference value from a first reference value.

The present invention comprises motor load detecting means for detecting an electrical value representing a rise characteristic of a motor which varies in accordance with a load acting on the motor, and determining means for receiving a detected value from the motor load detecting means during a predetermined spin-drying cycle, and detecting a time elapsed until the detected value reaches a second reference value from a first reference value, thereby determining a washings weight on the basis of the elapsed time.

According to the present invention, since the electrical value representing the rise characteristic of the motor, which varies in accordance with a load acting thereon, is detected, detection errors for the motor load are rarely produced. In addition, the determining means receives the detected value from the motor load detecting means during the spin-drying cycle. Therefore, unlike the case wherein the motor load is detected during the wash cycle, all clothes act on the motor as a load and do not irregularly vary. Therefore, the detected value corresponds to the motor load according to the washings weight. Thus, the determining means detects the time elapsed until the detected value reaches the second reference value from the first reference value, thereby accurately determining the washings weight on the basis of the elapsed time.

BRIEF DESCRIPTION OF THE DRAWINGS

These and other objects and features of the present invention can be understood through the following embodiments by reference to the accompanying drawings, in which:

FIGS. 2 to 9 show a first embodiment of the present invention, in which

FIG. 2 is a circuit diagram partially including a block diagram,

FIG. 3 is a graph showing a variety of rise characteristics of a motor,

FIG. 4 is a graph showing a relationship between a characteristic of a voltage across capacitor terminals of the motor and a motor load, FIG. 5 is a flow chart of a washings weight determining program, FIG. 6 is a table of a relationship between a detected voltage and a source voltage, FIG. 7 is a table of a relationship between a washings weight and an elapsed time, FIG. 8 is a flow chart of a water level setting subroutine, and FIG. 9 is a table of a relationship between a water level set in accordance with washings weight detection, a water level set by a user, and a decided water level;

DETAILED DESCRIPTION OF THE PREFERRED EMBODIMENTS

Preferred embodiments of the present invention will be described below with reference to the accompanying drawings.

Figure 1:
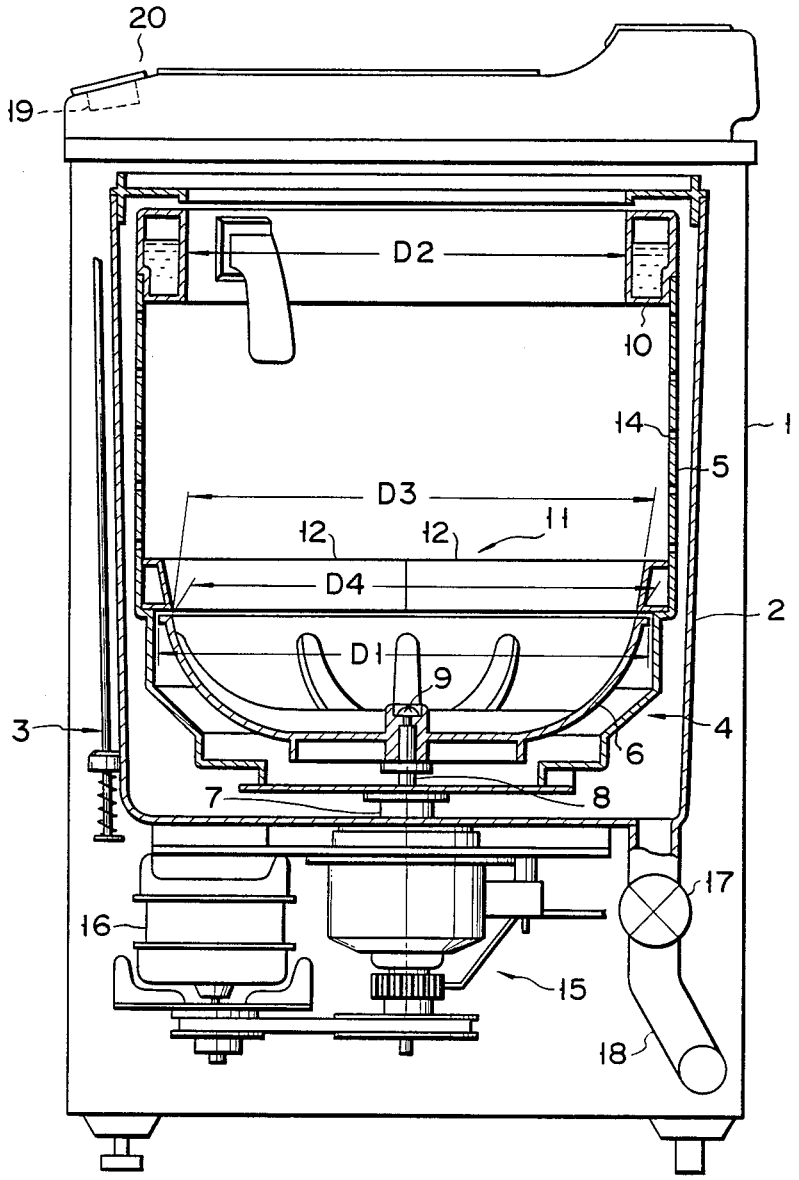
FIG. 1 is a sectional view showing a mechanism of an electric washing machine having both washing and spin-drying functions to which the present invention is applied.

FIG. 1 shows a mechanism of an electric washing machine having both washing and spin-drying functions which is applied to the present invention. In FIG. 1, reference numeral 1 denotes a casing in which water-receiving tub 2 is disposed to be elastically supported by suspending rod mechanism 3. Reference numeral 4 denotes a wash tub which also serves as a spin-drying tub and is constituted by cylindrical tub main body 5 and shallow vessel-like agitator 6. Main body 5 is rotatably arranged in water-receiving tub 2 and its outer bottom portion is connected and fixed to spin-drying shaft 7. Agitator 6 is arranged at an inner lower portion of main body 5, and its outer bottom portion is connected to wash shaft 8 and fixed thereto by screw 9. Main body 5 is made of a plastic material. An inner diameter of a portion of main body 5 located above agitator 6 is larger than that of a lower portion thereof where agitator 6 is arranged. Annular balancer 10 is fitted on an inner wall of an upper end portion of main body 5. Agitator 6 is made of a plastic material having high elasticity such as polypropylene. Outer diameter D1 of agitator 6 is set larger than a minimum inner diameter of the upper portion of main body 5, i.e., inner diameter D2 of balancer 10. However, agitator 6 can be deformed to be an ellipse whose width is smaller than diameter D2 of balancer 10 because of its elasticity. Reference numeral 11 denotes a ring-like inner member disposed at an intermediate level in the vertical direction along main body 5 such that its lower end is located near the upper end of agitator 6. Inner member 11 is tapered, i.e., its inner diameter of an upper end portion is larger than that of the lower end portion. Inner diameter D3 of the lower end portion of inner member 11 is set substantially the same as that of inner diameter D4 of the upper end of agitator 6. Inner member 11 is constituted by combining two semicircular hollow frame members 12. Frame members 12 are detachably mounted on main body 5. Reference numeral 14 denotes spin-drying holes formed in main body 5; 15, a power controlling mechanism which reduces a speed of motor 16 serving as a power source of the electric washing machine having both washing and spin-drying functions and transmits the force to only wash shaft 8 or to both spin-drying and wash shafts 7 and 8, and which incorporates a reduction mechanism, a clutch mechanism, a brake mechanism, and the like; 17, a drainage valve which can drain water in wash tub 4 from the bottom portion of water-receiving tub 2 through drainage hose 18; and 19, an operation control apparatus having operation panel 20 for automatically controlling respective cycles from wash to final spin-drying cycles.

In the above arrangement, during a wash operation, main body 5 is locked by the brake mechanism so as not to rotate and agitator 6 is forwardly/reversely rotated. Therefore, a wall portion of main body 5 exposed above agitator 6 serves as a fixed wall portion of wash tub 4, and that of agitator 6 serves as a movable wall portion thereof.

An operation of the above arrangement will be described below. During washing, washings are put into wash tub 4 together with water supplied from a water-supply valve (not shown). In this state, the wash operation is performed such that main body 5 is locked by the brake mechanism so as not to rotate and only agitator 6 is forwardly/reversely driven. In this embodiment, a rotation speed of agitator 6 falls within the range of 120 to 180 r.p.m., and a rotation direction thereof is reversed every two or three rotations.

In this wash operation, the washings are brought into contact with the wall of agitator 6 and that of main body 5. Therefore, the washings are subjected to a rotational force from agitator 6 at their lower portion due to friction therewith and are subjected to a locking force of main body 5 at their upper portion due to friction with its wall. As a result, the washings are subjected to frictional forces in different directions at the same time and hence receive a twisting or urging effect. In addition, this effect is repeatedly applied to the washings because agitator 6 is forwardly/reversely rotated. Moreover, the washings are urged against agitator 6 in the circumferential direction due to a centrifugal force along with rotation of agitator 6. In this case, the washings are subjected to the inward reaction force from the wall of main body 5 and hence are vertically and repeatedly moved. Thus, the washings move complicatedly.

As described above, the washings exhibit a complicated motion. Because of this complicated motion, the washings are subjected to a rubbing effect due to large friction between clothes and that between the walls of main body 5 and agitator 6 and subjected to a some kind of twisting effect due to repetitive twisting and urging. The resultant washing effect is better than that obtained by a conventional rotary vane system or a tub rotating system invented prior to the present invention.

In this wash operation, since a gap between an inner surface of main body 5 and agitator 6 is covered with inner member 11, the washings are not guided into the gap. In addition, inner member 11 does not cover the entire portion of the inner surface of main body 5 exposed above agitator 6 but covers it only partially. Therefore, a volume of main body 5 is not so reduced, thereby increasing a washings volume.

In this embodiment, a spin-drying operation is performed such that the clutch mechanism and the like (not shown) are operated after drainage performed by opening drainage valve 17, and main body 5 and agitator 6 are rotated integrally with each other in the same direction.

A control circuit section including a washings weight detector of the electric washing machine mechanism described above as main part of the present invention will be described in accordance with the first embodiment with reference to FIGS. 2 to 9.

Figure 2:
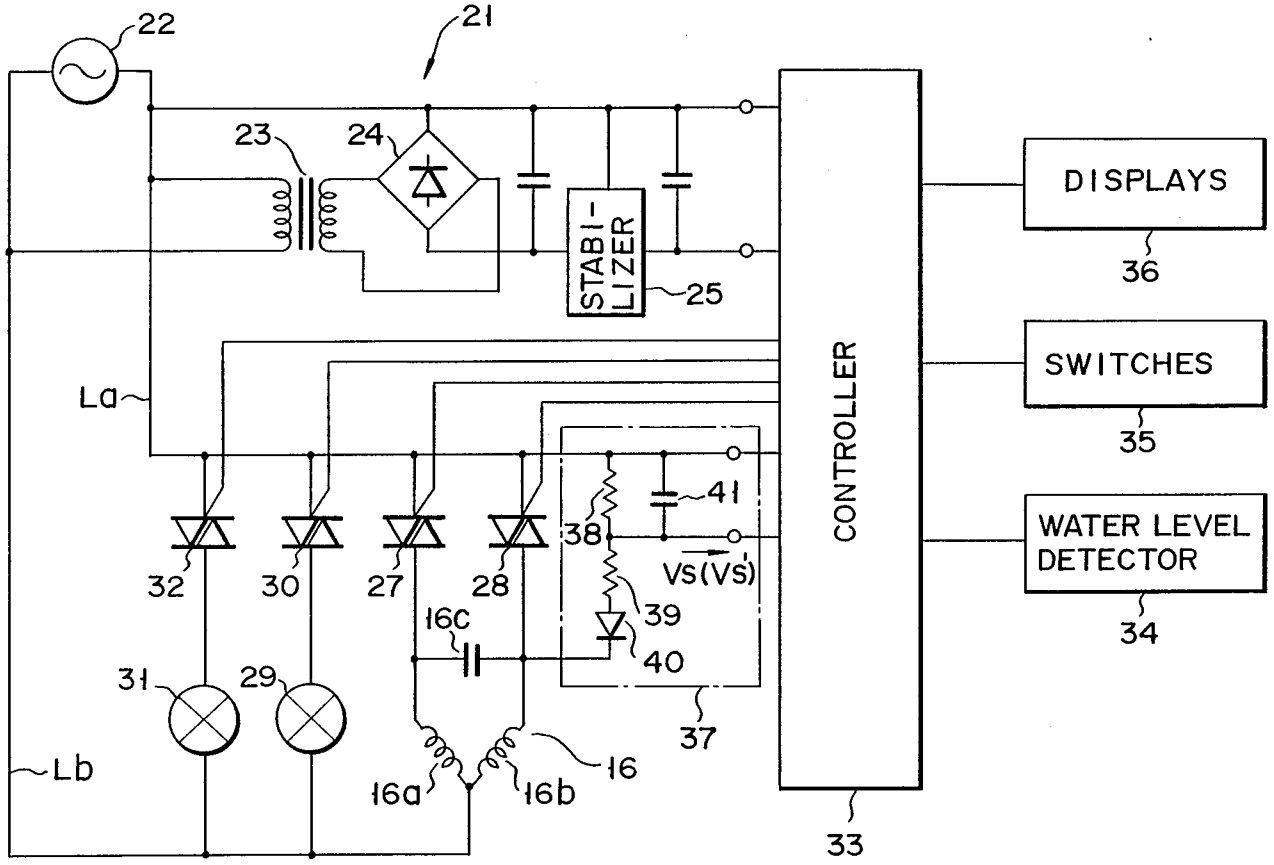

In FIG. 2, reference numeral 21 denotes a control power source circuit, consisting of step-down transformer 23, rectifier 24, and stabilizer 25, for receiving a control DC source voltage from AC power source 22. The control DC source voltage of circuit 21 is applied to controller 33 to be described later. Between buses La and Lb of power source 22, first-phase winding 16*a* of motor 16 which serves as a power source of the electric washing machine having both washing and spin-drying functions is connected through triac 27, second-phase winding 16*b* thereof is connected through triac 28, water-supply valve 29 consisting of a normally-closed solenoid is connected through triac 30, and drainage valve 31 (corresponding to drainage valve 17) consisting of a normally-closed solenoid is connected through triac 32. Motor 16 consists of a capacitor motor, and reference numeral 16*c* denotes its capacitor. Reference numeral 33 denotes controller consisting of a microcomputer including a predetermined A/D converter at its input port. Controller 33 turns on/off triacs 27, 28, 30, and 32 in accordance with an operation control program stored in an internal memory, thereby controlling cycles. For example, controller 33 sequentially executes first water-supply, wash, first drainage, first spin-drying, second water-supply, rinse, second drainage, and second spin-drying cycles. Control of each cycle will be briefly described below.

First and second water-supply cycles: Triac 30 is turned on (other triacs 27, 28, and 32 are turned off), water-supply valve 29 is opened, and when a water level in wash tub 4 reaches a preset water level, triac 30 is turned off.

Wash cycle: Triacs 27 and 28 are alternately turned on with predetermined OFF intervals (other triacs 30 and 32 are turned off), thereby rotating agitator 6 intermittently in forward and reverse directions. Then, triacs 27 and 28 are turned off upon elapse of a preset time.

First and second drainage cycles: Triac 32 is turned on (other triacs 27, 28, and 30 are turned off) to open water-supply valve 31. Then, triac 32 is turned off upon elapse of a preset time or detection of drainage completion.

First and second spin-drying cycles: Triacs 27 and 32 are turned on to open drainage valve 31. In this state, motor 16 is driven to rotate wash tub 4 which also serves as a spin-drying tub at a high speed. Then, triac 27 is turned off upon elapse of a preset time or detection of spin-drying completion. Thereafter, triac 32 is turned off.

First and second rinse cycles: Triac 30 is turned on, and triacs 27 and 28 are alternately turned on with predetermined OFF intervals, thereby rotating agitator 6 intermittently in forward and reverse directions while supplying water. Then, triacs 27, 28, and 30 are turned off upon elapse of a preset time or detection of rinse completion.

Note that reference numeral 34 denotes a water level detector for detecting a water level; 35, a variety of switches arbitrarily operated by a user, e.g., a start switch, a water level set switch, a wash time selection switch, a spin-drying time selection switch included in operation control apparatus 19 provided at panel 20; and 36, a variety of displays provided similarly to switches 35, e.g., a cycle content display and a time display.

Figure 3:
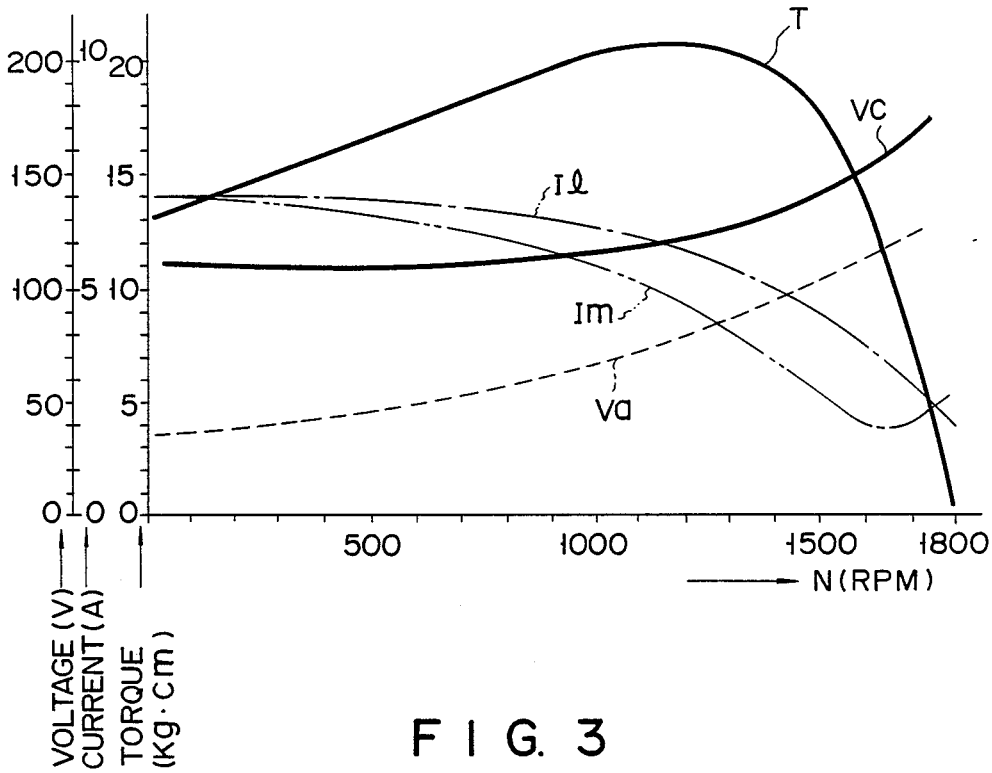
Figure 4:
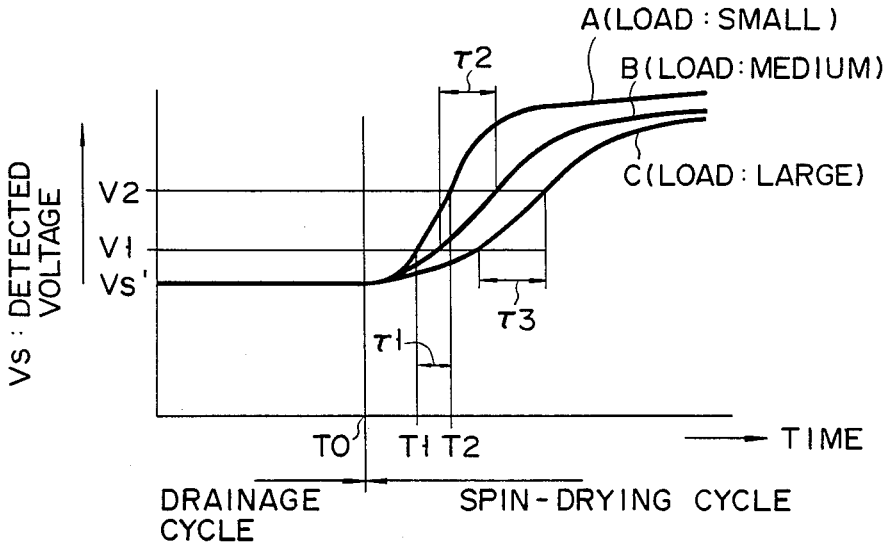

Reference numeral 37 denotes a load detector serving as a motor load detecting means. An arrangement of detector 37 is such that a series circuit consisting of voltage-dividing resistors 38 and 39 and rectifying diode element 40 is connected between bus La and a terminal point between second-phase winding 16*b* and capacitor 16*c*. Smoothing capacitor 41 is connected between bus La and a common node of resistors 38 and 39. When triac 27 is turned on and hence motor 16 is driven (at this time, first-phase winding 16*a* serves as a main winding and second-phase winding 16*b* serves as an auxiliary winding), load detector 37 divides voltage Vc across terminals of capacitor 16*c* and outputs a divided voltage as detected voltage Vs (detected value). FIG. 3 shows characteristics obtained when the speed of motor 16 rises. In FIG. 3, curve T represents a torque change; curve Vc, a voltage change across the terminals of capacitor 16*c*; cur auxiliary winding voltage change; curve Il, an input current change; and curve Im, a main winding current change. In this case, voltage Vc is one of the electrical values representing the rise characteristics which vary in accordance with a load acting on motor 16. FIG. 4 shows a difference in the rise characteristics. In FIG. 4, voltage Vc across the terminals of capacitor 16*c* is replaced with detected voltage Vs. As is apparent from a comparison between curve A (load: small), curve B (load: medium), and curve C (load: large) in FIG. 4, as the load increases, rise speed of the curve is reduced. When motor 16 is driven, load detector 37 detects voltage Vc as described above. However, when motor 16 is not driven (i.e., triacs 27, 28, 30, and 32 are turned off), detector 37 outputs a divided voltage corresponding to source voltage Vac of power source 22 since no voltage is generated across the terminals of capacitor 16*c*. This divided voltage output when motor 16 is not driven is referred to as detected voltage Vs' so as to be distinguished from detected voltage Vs of voltage Vc. Source voltage Vac can be determined in accordance with detected voltage Vs'. That is, detector 37 also has a function of detecting source voltage Vac.

Controller 33 stores a determination program for determining a washings weight in addition to the operation control program described above and determines a washings weight in accordance with the determination program during the spin-drying cycle (e.g., the first spin-drying cycle) before the wash or rinse cycle. In this case, a determination factor is elapsed time $\tau$ ($\tau 1$, $\tau 2$, and $\tau 3$) shown in FIG. 4. Elapsed time $\tau$ is a time elapsed while detected voltage Vs reaches from first reference value V1 to second reference value V2 and differs ($\tau 1$, $\tau 2$, and $\tau 3$) in accordance with the load as is apparent from comparison between curves A, B, and C.

A washings weight determination operation of controller 33 will be described below with reference to also the flow chart of the determination program shown in FIG. 5. Controller 33 sets first and second reference values Vl and V2 with respect to detected voltage Vs such that $V1 = 1.2\ Vs'$ and $V2 = 1.5\ Vs'$. In this case, values Vl and V2 are calculated in accordance with detected value Vs' which is a detected value of source voltage Vac obtained when motor 16 is stopped. Therefore, a determination function of the determination program is executed substantially when the drainage cycle (first drainage cycle) prior to the spin-drying cycle is executed.

Figure 5:
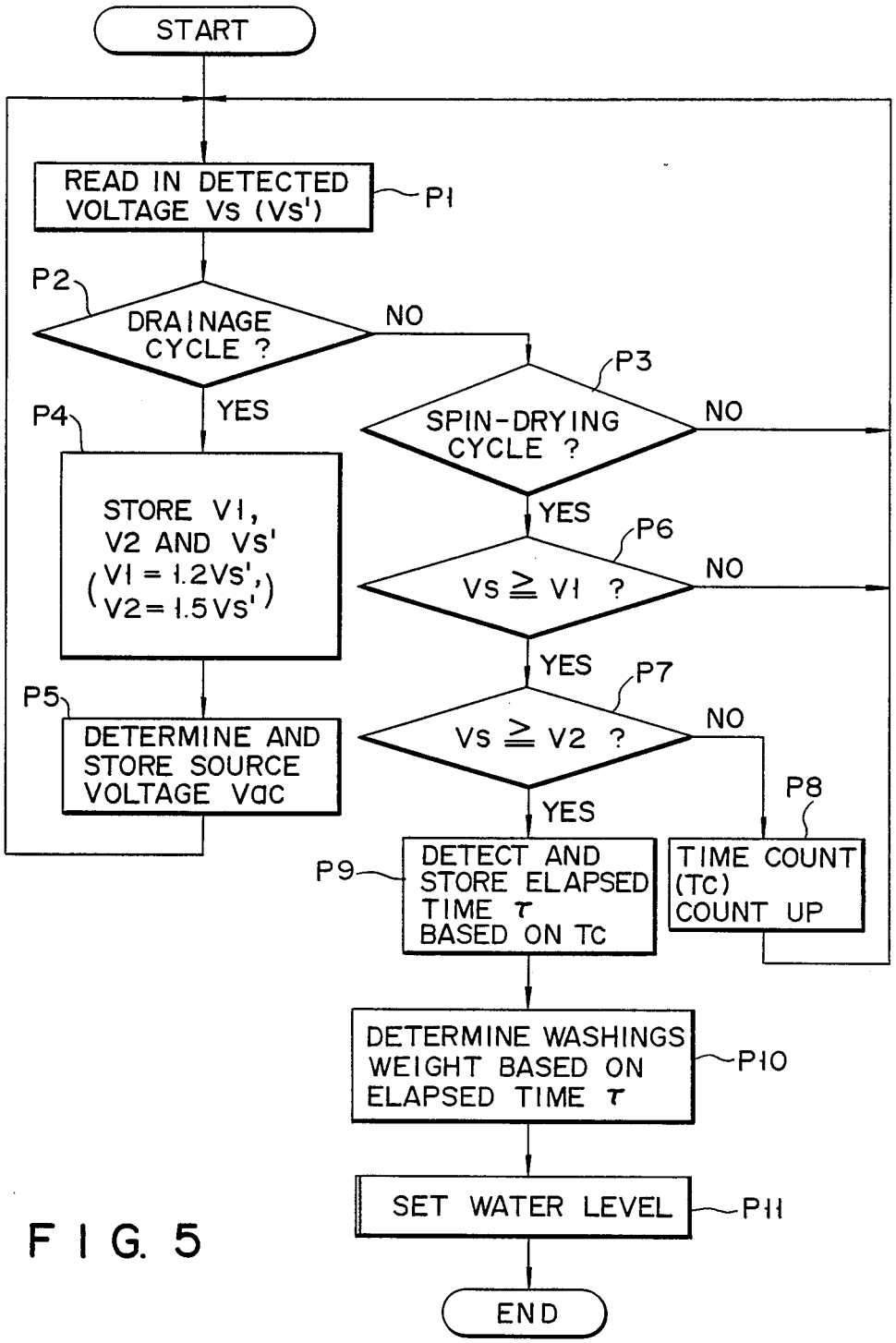

When the start switch is turned on to start the washing operation, controller 33 reads in the detected voltage (voltage Vs when motor 16 is driven and voltage Vs' when motor 16 is not driven) output from load detector 37, as shown in step Pl of FIG. 5. In step P2, controller 33 determines whether a cycle executed at that time is the drainage cycle. Since the washing operation is executed sequentially from the first water-supply cycle, the wash cycle, . . . , as described above, the flow advances from step P2 to P3. In step P3, controller 33 determines whether a cycle executed at that time is the first spin-drying cycle. In this case, since the cycle executed at that time is not the first spin-drying cycle, the flow returns to step Pl. When the water-supplying and wash cycles are sequentially executed and the first drainage cycle is started, a closed loop such as step P2→step P4→step P5→step P1→step P2 . . . is executed during the first drainage cycle. That is, in step P1, detected voltage Vs' with respect to source voltage Vac is read in since the first drainage cycle is executed, i.e., motor 16 is stopped. In step P4, first and second reference values V1 and V2 are calculated in accordance with voltage Vs', and Vs', V1, and V2 are stored in a memory. In step P5, controller 33 determines source voltage Vac in accordance with detected voltage Vs' and causes the memory to store Vac. Thereafter, the flow returns to step P1. FIG. 6 shows reference values for determining voltage Vac. That is, when detected voltage Vs' is below 2.28 [V], controller 33 determines that source voltage Vac is below 94 [V], and when voltage Vs' falls within the range of 2.28 to 2.38 [V], controller 33 determines voltage Vac falls within the range of 94 to 98 [V].

Figures 8, 9:
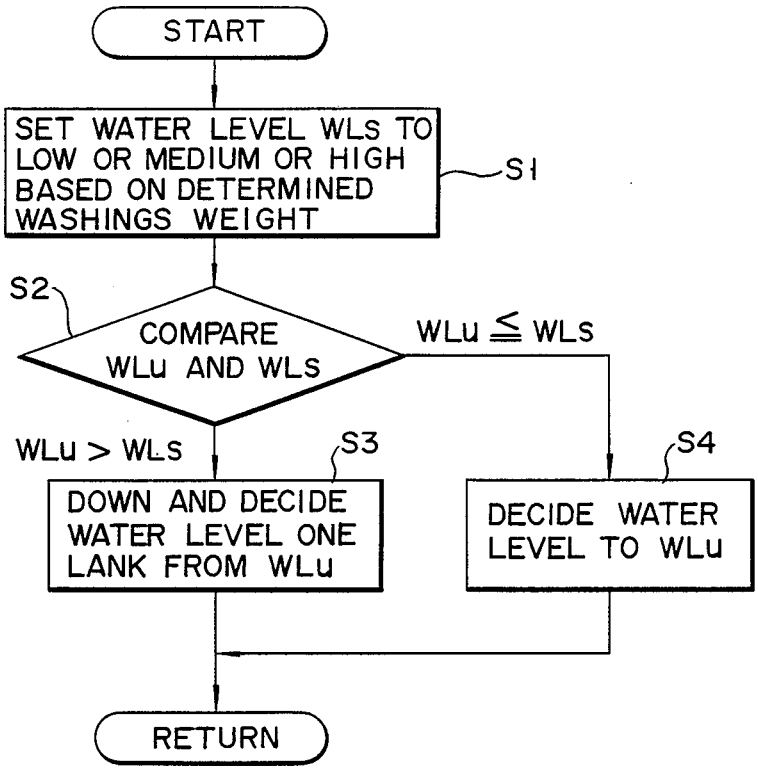

Thereafter, when the first drainage cycle is completed and the first spin-drying cycle is started at time T0 (see FIG. 4), the flow advances to step P6 through steps P2 and P3. During the first spin-drying cycle, load detector 37 detects a voltage across the terminals of capacitor 16c of motor 16 and outputs detected voltage Vs. In step P6, controller 33 determines whether voltage Vs has reached first reference value V1. If NO in step P6, controller 33 executes a loop such as step P6→step P1→step P2 step P3→step P6 . . . In this case, if the rise characteristic of motor 16 is represented by curve A of FIG. 4, voltage Vs reaches value V1 at time T1 shown in FIG. 4. Then, the flow advances from step P6 to P7. In step P7, controller 33 determines whether voltage Vs has reached second reference value V2. If NO in step P7, the flow advances to step P8. In step P8, count value Tc (initial value 0) with respect to time count is counted up, and then the flow returns to step P1. When voltage Vs reaches value V2 at time T2 in FIG. 4, the flow advances from step P7 to P9 (i.e., count up in step P8 is not executed thereafter). Therefore, elapsed time $\tau$ which has elapsed while value Tc, i.e., voltage Vs reaches from value V1 to value V2 is detected. Elapsed time$\tau$ is stored in the memory in step P9. Then, controller 33 determines the load acting on motor 16, i.e., washings weight on the basis of time$\tau$. This determination is performed in accordance with the relationship shown in FIG. 7. For example, when source voltage Vac is 100 [V] and time $\tau$ is 5.2 seconds, Y3 X1 of time matrix corresponds thereto, so that the washings weight is determined to be small. This determination result is used as data for setting a water level in the second water-supply cycle before the rinse cycle in water level set subroutine P11. The contents of subroutine P11 are shown in FIG. 8. In FIG. 8, water level WLs is automatically set to low, medium, or high on the basis of a washings weight determined in step S1. That is, when the determined washings weight is small, WLs is set to low, when the washings weight is medium, WLs is set to medium, and when the washings weight is large, WLs is set to high, respectively. In step S2, controller 33 compares water level WLs and water level WLu (high, medium, low, or lower) set by a user. If WLu>WLs, the water level is decided one rank down from WLu (step S3). At this time, the decided water level is either of decided levels denoted by symbol "⊡" in FIG. 9. If WLu≦WLs, the water level is decided to WLu (step S4). A main purpose of correcting and deciding the water level on the basis of a difference between water level WLs set in accordance with the washings weight and water level WLu set by the user is to minimize waste of water.

According to the above embodiment, load detector 37 detects the voltage across capacitor 16c of motor 16, i.e., detector 37 is a pure electrical means for detecting an electrical value representing the characteristic which varies in accordance with the load of motor 16 when motor 16 rises. Therefore, unlike a conventional capacitive or differential transformer type weight sensor, detector 37 can accurately detect the load acting on motor 16. In addition, since controller 33 obtains detected voltage Vs for determining the washings weight during the spin-drying cycle, voltage Vs, i.e., the load acting on motor 16 corresponds to the actual washings weight in wash tub 4. That is, all washings act as a load on motor 16 during the spin-drying cycle. Therefore, unlike in the wash cycle, the washings reliably act as a load on motor 16 and the load is not irregularly varied. As a result, the washings weight can be accurately determined on the basis of elapsed time$\tau$which has elapsed while detected voltage Vs reaches from first reference value V1 to second reference value V2.

Moreover, according to this embodiment, since value V1 is set higher than voltage Vs' corresponding to the initial value of voltage Vs, a detection time length of time $\tau$ does not include a time immediately after the spin-drying cycle is started. Therefore, the washings weight can be determined more accurately. That is, at a time immediately after the spin-drying cycle is started, the rotary tub is sometimes rotated in an unbalanced state due to unbalanced distribution of the washings, and the load acting on motor 16 largely varies due to this unbalanced rotation. Therefore, in this embodiment, the arrangement is such that the load variation is not detected.

Furthermore, according to this embodiment, the washings weight is determined in accordance with detected elapsed time $\tau$ and in consideration of a value of source voltage Vac. Therefore, a washings weight determination error caused by variations in voltage Vac can be eliminated. In this case, since load circuit 37 can detect voltage Vac when motor 16 is stopped, no other source voltage detector i necessary.

Figure 10:
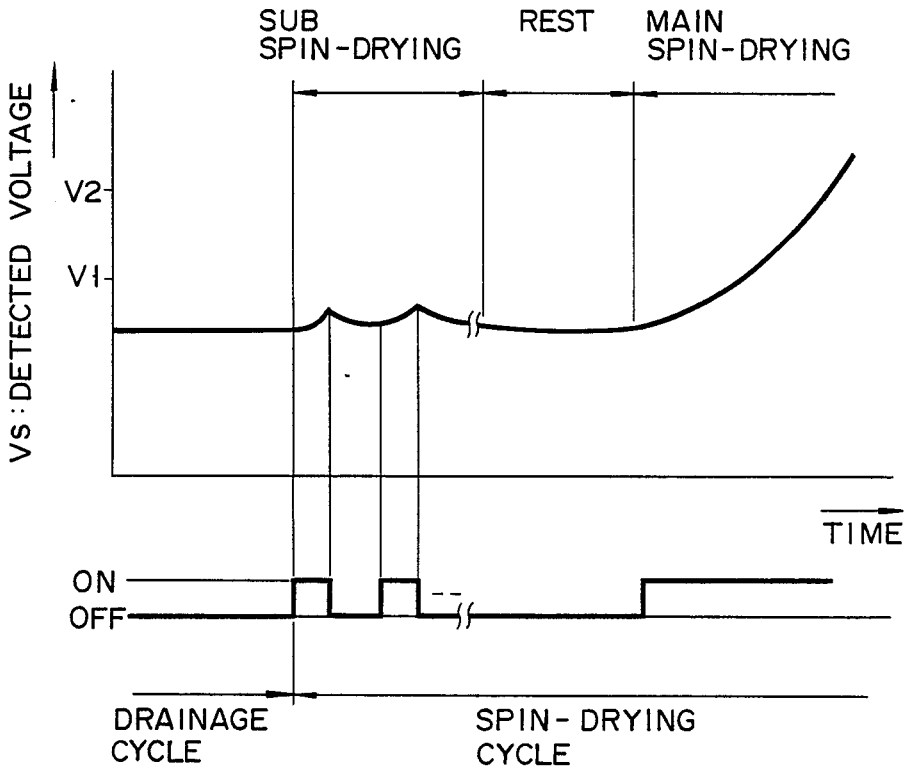
FIG. 10 is a graph of a relationship between a motor ON/OFF state and a detected voltage according to a second embodiment of the present invention.

FIG. 10 shows a second embodiment of the controller section including the washings weight detector according to the present invention. In this second embodiment, control in the spin-drying cycle differs from that of the first embodiment. That is, at an initial period of the spin-drying cycle, sub spin-drying for intermittently driving motor 16 (i.e., intermittently turning on triac 27) is executed for, e.g., one minute. Thereafter, motor 16 is set in a rest interval, i.e., stopped for, e.g., 20 seconds, and then main spin-drying in which motor 16 is continuously driven is executed. In this main spin-drying, the elapsed time is detected for determining the washings weight as described above. According to the second embodiment, the washings weight can be determined more accurately. That is, in a power transmission mechanism from motor 16 to wash tub 4 and a mechanism associated therewith, grease is charged into rotating/sliding portions such as a seal portion for sealing against water and a bearing portion. However, in winter, viscosity of the grease becomes so high that the grease acts as a large load element on motor 16 in addition to washings. Moreover, since a large amount of water exists in wash tub 4 in the initial period of the spin-drying cycle, the water also acts as a large load element on motor 16 in addition to the washings. However, in this embodiment, motor 16 is intermittently driven to intermittently rotate the rotary tub, thereby increasing a temperature of the rotating/sliding portions to reduce the viscosity of the grease. At the same time, a large amount of water can be removed before load detection. Therefore, the load elements other than the washings can be removed, so that the washings weight can be determined more accurately.

Note that in the above embodiment, the voltage across the terminals of capacitor 16*c* of motor 16 is detected. However, a current input to motor 16, a main winding current, or the like can also be used as an electrical value representing the characteristic which varies in accordance with the load acting on motor 16. Therefore, an object to be detected is not limited to the above voltage. In addition, first and second reference values V1 and V2 can be arbitrarily changed.

The present invention is not limited to the above embodiments but can be modified without departing from the spirit and scope of the invention.

Figure 11:
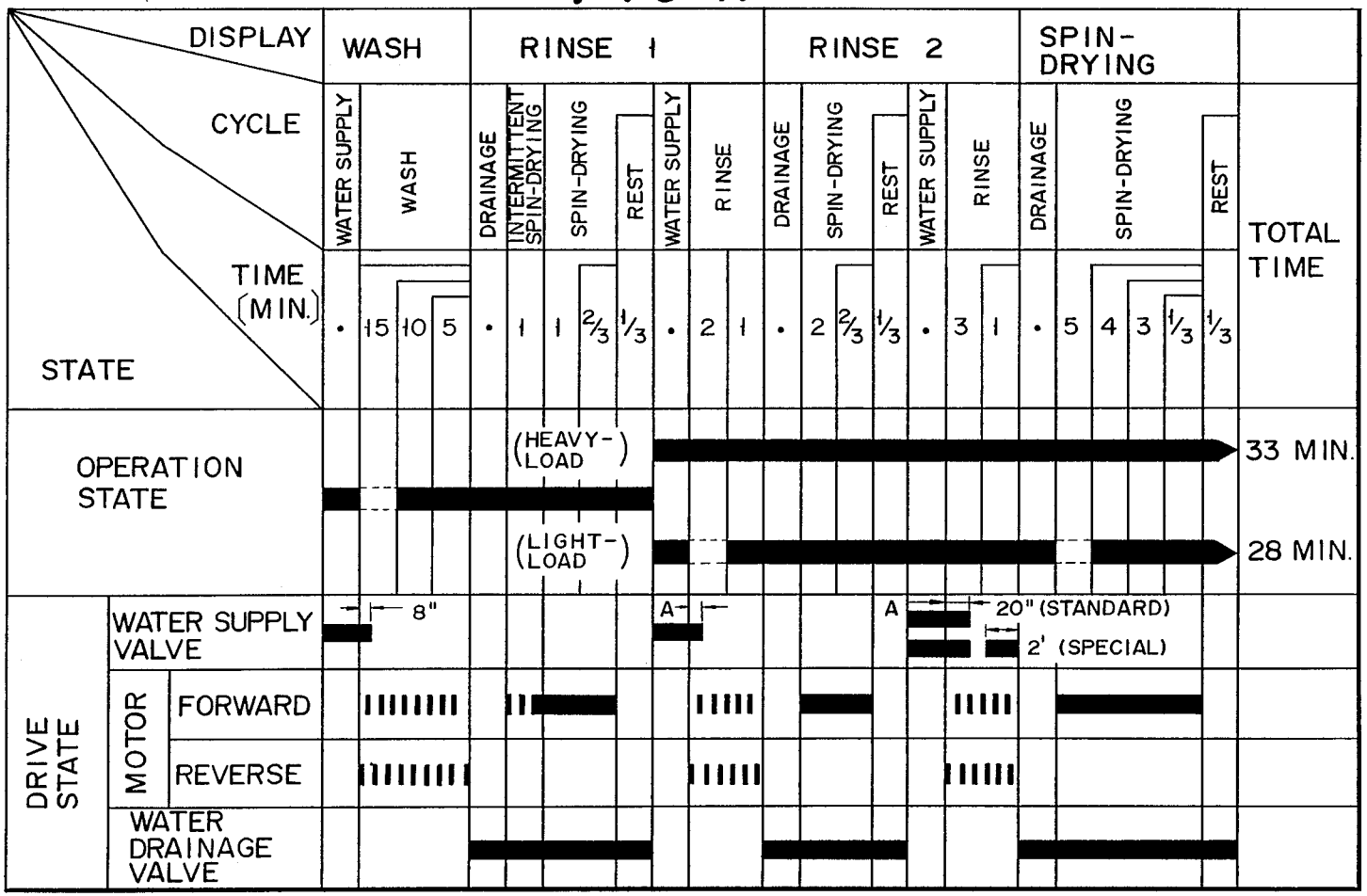
FIG. 11 is a view of overall washing operation cycles for explaining another embodiment of the present invention.

For example, in the above embodiments, the washings weight detection data is used only as the water level set data for the rinse cycle. However, this data may be used as time set data for the rinse cycle and that for the second spin-drying cycle. FIG. 11 shows overall cycles of the washing operation described above. In FIG. 11, it is determined whether the washings weight detection data is large or small. If the data is determined to be small, times for the rinse and the second spin-drying cycles are shortened than those of the cycles executed when the data is large, thereby improving the efficiency. Note that in FIG. 11, drive states of the motor, the water-supply valve, and the drainage valve are shown in addition to the operation state.

As is apparent from the above description, the present invention is a washings weight detection apparatus for an electric washing machine having both washing and spin-drying functions, comprising a motor load detecting means for detecting an electrical value representing the rise characteristic which varies in accordance with a load acting on a motor, and a determining means for receiving a detected value from the motor load detecting means in a predetermined spin-drying cycle and detecting an elapsed time which has elapsed while the detected value reaches a second reference value from a first reference value, thereby determining a washings weight on the basis of a detected time. With this arrangement, a load acting on the motor can be accurately detected in correspondence to the washings weight, and the washings weight detection accuracy can be greatly improved.

Moreover, according to the present invention, a series of washing operations can be controlled well on the basis of the washings weight detection data which can be accurately obtained as described above.

What is claimed is:

1. A washings weight detection apparatus for use in an electric washing machine, said apparatus comprising:

an electric washing machine main body for washing and spin-drying clothes;

a motor serving as a power source for both a wash cycle and a spin-drying cycle executed by said main body;

a capacitor connected across two windings of said motor;

motor load detecting means for detecting a voltage across terminals of said capacitor representing a rise characteristic which varies in accordance with a load acting on said motor;

determining means for receiving the detected voltage from said motor load detecting means during the spin-drying cycle and determining a washings weight in said main body on the basis of information concerning time which has elapsed until the detected voltage reaches a second reference voltage from a first reference voltage;

said determining means dividing the elapsed time into a plurality of time lengths for determining the washings weight as large, medium, or small; and source voltage detecting means for detecting a source voltage of said motor into a plurality of divided values, and said determining means determine the washings weight in accordance with a relationship between the plurality of time lengths and the plurality of divided values of the source voltage detected by said source voltage detecting means.

2. An apparatus according to claim 1, wherein said motor load detecting means includes voltage dividing means for dividing the voltage across the terminal of said capacitor.

3. An apparatus according to claim 1, wherein said motor load detecting means includes rectifying means for rectifying the voltage across the terminals of said capacitor.

4. An apparatus according to claim 1, wherein the first and second reference voltages are set in accordance with the voltage applied across the terminals of said capacitor when said motor is stopped.

5. An apparatus according to claim 1, wherein the first reference voltage is set higher than the voltage applied across the terminals of said capacitor when said motor is stopped.

6. A washing operation control apparatus for an electric washing machine, said apparatus comprising:

an electric washing machine main body for washing and spin-drying;

a motor serving as a power source for a series of operations including a wash cycle and a spin-drying cycle executed by said main body;

first control means for controlling a drive power for said motor;

second control means for controlling water supply to said main body;

third control means for controlling water drainage from said main body;

fourth control means for setting said first, second, or third control means in an operative state and controlling a program of the series of operations including the wash and spin-drying cycles executed by said electric washing machine main body;

motor load detecting means for detecting an electrical value representing a rise characteristic which varies in accordance with a load acting on said motor;

determining means for receiving a detected value from said motor load detecting means during the spin-drying cycle and determining a weight of washings contained in said electric washing machine main body, in accordance with time which has elapsed until the detected value reaches a second reference value from a first reference value, said determining means dividing the elapsed time into a plurality of time lengths and determining the washing weight;

setting means for setting water level data to be used in a rinse cycle subsequent to the spin-drying cycle in accordance with the washings weight determined y said determining means, wherein the water level is determined to be WLu when WLu≦WLs, and to be a level immediately below the level of WLu when WLu>WLs, where WLs is one of three water levels "high", "medium" and "low" automatically set in accordance with the determined washings weight, and WLu is one of three levels "high", "medium" and "low" which has been set by a user; and source voltage detecting means for detecting a source voltage of said motor into a plurality of divided values, and said determining means determining the washings weight in accordance with a relationship between the plurality of time lengths and the plurality of divided of the source voltage detected by said source voltage detecting means.

7. A washings weight detection apparatus for use in an electric washing machine, said apparatus comprising:

an electric washing machine main body for washing and spin-drying clothes;

a motor serving as a power source for both a wash cycle and a spin-drying cycle executed by said main body;

a capacitor connected across two windings of said motor;

motor load detecting means for detecting a voltage across terminals of said capacitor representing a rise characteristic which varies in accordance with a load acting on said motor; and determining means for receiving the detected voltage from said motor load detecting means during the spin-drying cycle and determining a washings weight in said main body on the basis of information concerning time which has elapsed until the detected voltage reaches a second reference voltage form a first reference voltage, the first and second reference values being set in accordance with the voltage applied across the terminals of said capacitor when said motor is stopped and the first reference value being set higher than the voltage applied across the terminals of said capacitor when said motor is stopped.

8. An apparatus according to claim 7, wherein said determining means divides the elapsed time into a plurality of time lengths and determines the washings weight.

9. An apparatus according to claim 8. wherein the plurality of time lengths are divided to determine whether the washings weight is large, medium, or small.

10. An apparatus according to claim 7, wherein said apparatus further comprises source voltage detecting means for detecting a source voltage of said motor into a plurality of divided values, and said determining means determines the washings weight in accordance with a relationship between the plurality of time lengths and the plurality of divided values of the source voltage detected by said source voltage detecting means.

* * * * *